US011467525B2

(12) United States Patent
Wakabayashi

(10) Patent No.: US 11,467,525 B2
(45) Date of Patent: Oct. 11, 2022

(54) POST-PROCESSING APPARATUS

(71) Applicant: KONICA MINOLTA, INC., Tokyo (JP)

(72) Inventor: Hiroyuki Wakabayashi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 657 days.

(21) Appl. No.: 16/543,678

(22) Filed: Aug. 19, 2019

(65) Prior Publication Data

US 2020/0096930 A1 Mar. 26, 2020

(30) Foreign Application Priority Data

Sep. 26, 2018 (JP) ..... JP2018-179796

(51) Int. Cl.

*G03G 15/00* (2006.01)
*B65H 9/00* (2006.01)
*B65H 9/06* (2006.01)
*B65H 9/10* (2006.01)

(52) U.S. Cl.

CPC ..... *G03G 15/6576* (2013.01); *B65H 9/004* (2013.01); *B65H 9/06* (2013.01); *B65H 9/106* (2013.01); *B65H 2801/27* (2013.01)

(58) Field of Classification Search

CPC ..... B65H 9/101; B65H 9/16; B65H 9/004; B65H 9/006; B65H 9/008; B65H 9/002
USPC ..... 271/236, 239, 240
See application file for complete search history.

(56) References Cited

U.S. PATENT DOCUMENTS 5,681,036 A * 10/1997 Wakahara ..... B65H 9/004 271/238
6,059,285 A * 5/2000 Suga ..... H04N 1/00681 271/228
7,306,221 B2 * 12/2007 Agata ..... B65H 5/062 271/251
8,371,578 B2 * 2/2013 Ishikawa ..... B65H 7/06 271/226

(Continued)

FOREIGN PATENT DOCUMENTS

JP 3847884 B2 * 11/2006
JP 4846623 B2 12/2011

(Continued)

*Primary Examiner* — Patrick Cicchino
(74) *Attorney, Agent, or Firm* — Holtz, Holtz & Volek PC

(57) ABSTRACT

A post-processing apparatus performs post-processing on a paper sheet conveyed from a previous stage side, and includes: a corrector that performs bend correction on the paper sheet, in accordance with one of a plurality of bend correction methods; a post-processor that performs the post-processing on the paper sheet subjected to the bend correction performed by the corrector; and a hardware processor that selects one of the plurality of bend correction methods, on the basis of a bend correction accuracy corresponding to a product to be created by the post-processing being performed by the post-processor, and a productivity of the product, wherein from the plurality of bend correction methods, the hardware processor selects a bend correction method that reduces a difference between a post-processing time required for the post-processor to perform the post-processing and a correction time required for the corrector to perform the bend correction on the paper sheet.

7 Claims, 5 Drawing Sheets

| | BEND CORRECTION ACCURACY | | | | | | PRODUCTIVITY | ADVANTAGE(S) | DISADVANTAGE(S) |
|---|---|---|---|---|---|---|---|---|---|
| RIGIDITY | LOW | | | HIGH | | | | | |
| SIZE | SMALL | LARGE | LONG | SMALL | LARGE | LONG | | | |
| ROLLER REGISTRATION METHOD | ○ | ○ | ○ | × | × | × | ○ | ● ADVANTAGEOUS FOR THIN PAPER (PAPER SHEET PHYSICALLY COMES INTO CONTACT WITH REGISTRATION ROLLERS) | ● FUNCTION DETERIORATES FOR PAPER SHEET HAVING BASIS WEIGHT OF 135 g/m² OR LARGER (PAPER SHEET DOES NOT FORM LOOP AT REGISTRATION ROLLERS) |
| STEERING METHOD | ○ | ○ | × | ◎ | ◎ | × | ○ | ● ADVANTAGEOUS FOR PAPER SHEET WITH STIFFNESS<br>● BEND AMOUNT ADJUSTMENT IS POSSIBLE | ● DEPENDING ON BEND DETECTION PERFORMANCE<br>● DIFFICULT TO COPE WITH LONG PAPER SHEET |
| CD ALIGNMENT METHOD | ○ | ○ | ○ | ○ | ◎ | ◎ | × | ● ADVANTAGEOUS FOR PAPER SHEET WITH STIFFNESS<br>● ADVANTAGEOUS FOR BEND CORRECTION ACCURACY FOR SIZE SUITABLE FOR ALIGNMENT AT LONG SIDE | ● PRODUCTIVITY IS LOW DUE TO SUSPENSION OF SHEET CONVEYANCE |

◎: EXCELLENT ○: GOOD ×: POOR/UNACCEPTABLE/DISCARDED

(56) References Cited

U.S. PATENT DOCUMENTS

2021/0403262 A1* 12/2021 Iwata ..... B65H 7/04

FOREIGN PATENT DOCUMENTS

| | | | |
|---|---|---|---|
| JP | 2013039998 | A | 2/2013 |
| JP | 5445510 | B2 | 3/2014 |

* cited by examiner

FIG. 4

| | BEND CORRECTION ACCURACY | | | | | | PRODUCTIVITY | ADVANTAGE(S) | DISADVANTAGE(S) |
|---|---|---|---|---|---|---|---|---|---|
| RIGIDITY | LOW | | | HIGH | | | | | |
| SIZE | SMALL | LARGE | LONG | SMALL | LARGE | LONG | | | |
| ROLLER REGISTRATION METHOD | ○ | ○ | ○ | × | × | × | ○ | ● ADVANTAGEOUS FOR THIN PAPER (PAPER SHEET PHYSICALLY COMES INTO CONTACT WITH REGISTRATION ROLLERS) | ● FUNCTION DETERIORATES FOR PAPER SHEET HAVING BASIS WEIGHT OF 135 g/m$^2$ OR LARGER (PAPER SHEET DOES NOT FORM LOOP AT REGISTRATION ROLLERS) |
| STEERING METHOD | ○ | ○ | × | ◎ | ◎ | × | ○ | ● ADVANTAGEOUS FOR PAPER SHEET WITH STIFFNESS<br>● BEND AMOUNT ADJUSTMENT IS POSSIBLE | ● DEPENDING ON BEND DETECTION PERFORMANCE<br>● DIFFICULT TO COPE WITH LONG PAPER SHEET |
| CD ALIGNMENT METHOD | ○ | ○ | ○ | ○ | ◎ | ◎ | × | ● ADVANTAGEOUS FOR PAPER SHEET WITH STIFFNESS<br>● ADVANTAGEOUS FOR BEND CORRECTION ACCURACY FOR SIZE SUITABLE FOR ALIGNMENT AT LONG SIDE | ● PRODUCTIVITY IS LOW DUE TO SUSPENSION OF SHEET CONVEYANCE |

◎: EXCELLENT ○: GOOD ×: POOR/UNACCEPTABLE/DISCARDED

POST-PROCESSING APPARATUS

The entire disclosure of Japanese patent Application No. 2018-179796, filed on Sep. 26, 2018, is incorporated herein by reference in its entirety.

BACKGROUND

Technological Field

The present disclosure relates to a post-processing apparatus.

Description of the Related Art

A post-processing apparatus that performs post-processing on a paper sheet having an image formed thereon by an image forming apparatus is used in conventional cases. Such post-processing apparatuses include a post-processing apparatus that divides and cuts a paper sheet into pieces, and then outputs products, for example. In a suggested technology, in a case where bend correction is performed on a paper sheet by aligning the position of the paper sheet before the paper sheet is cut in such a post-processing apparatus, a different bend correction method is selected depending on the number of products (see JP 2013-039998 A, for example). In another suggested technology, a sheet bend correction method using registration rollers or a sheet bend correction method using steering rollers is selected depending on the width and the type of the products (see JP 5445510 B2, for example). In yet another suggested technology, a different bend correction method is selected from among bend correction methods, depending on post-processing (see JP 4846623 B2, for example).

However, by the conventional technologies disclosed in JP 2013-039998 A, JP 5445510 B2, and JP 4846623 B2, the bend correction accuracy for paper sheets can be increased, but the overall productivity is not taken into consideration. Therefore, there is a possibility that a waiting time may be generated a number of times between the step of correcting a bend of a paper sheet and the step of performing post-processing on the paper sheet. As a result, it is possible to increase bend correction accuracy for paper sheets, but the overall productivity might drop.

SUMMARY

The present disclosure is made in view of such circumstances, and an object thereof is to reduce decrease in overall productivity while improving bend correction accuracy for paper sheets.

To achieve the abovementioned object, according to an aspect of the present invention, a post-processing apparatus performs post-processing on a paper sheet conveyed from a previous stage side, and the post-processing apparatus reflecting one aspect of the present invention comprises: a corrector that performs bend correction on the paper sheet, in accordance with one of a plurality of bend correction methods; a post-processor that performs the post-processing on the paper sheet subjected to the bend correction performed by the corrector; and a hardware processor that selects one of the plurality of bend correction methods, on the basis of a bend correction accuracy corresponding to a product to be created by the post-processing being performed by the post-processor, and a productivity of the product, wherein from the plurality of bend correction methods, the hardware processor selects a bend correction method that reduces a difference between a post-processing time required for the post-processor to perform the post-processing and a correction time required for the corrector to perform the bend correction on the paper sheet.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 4 is a diagram for explaining the features of respective methods for bend correction according to the embodiment of the present disclosure.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
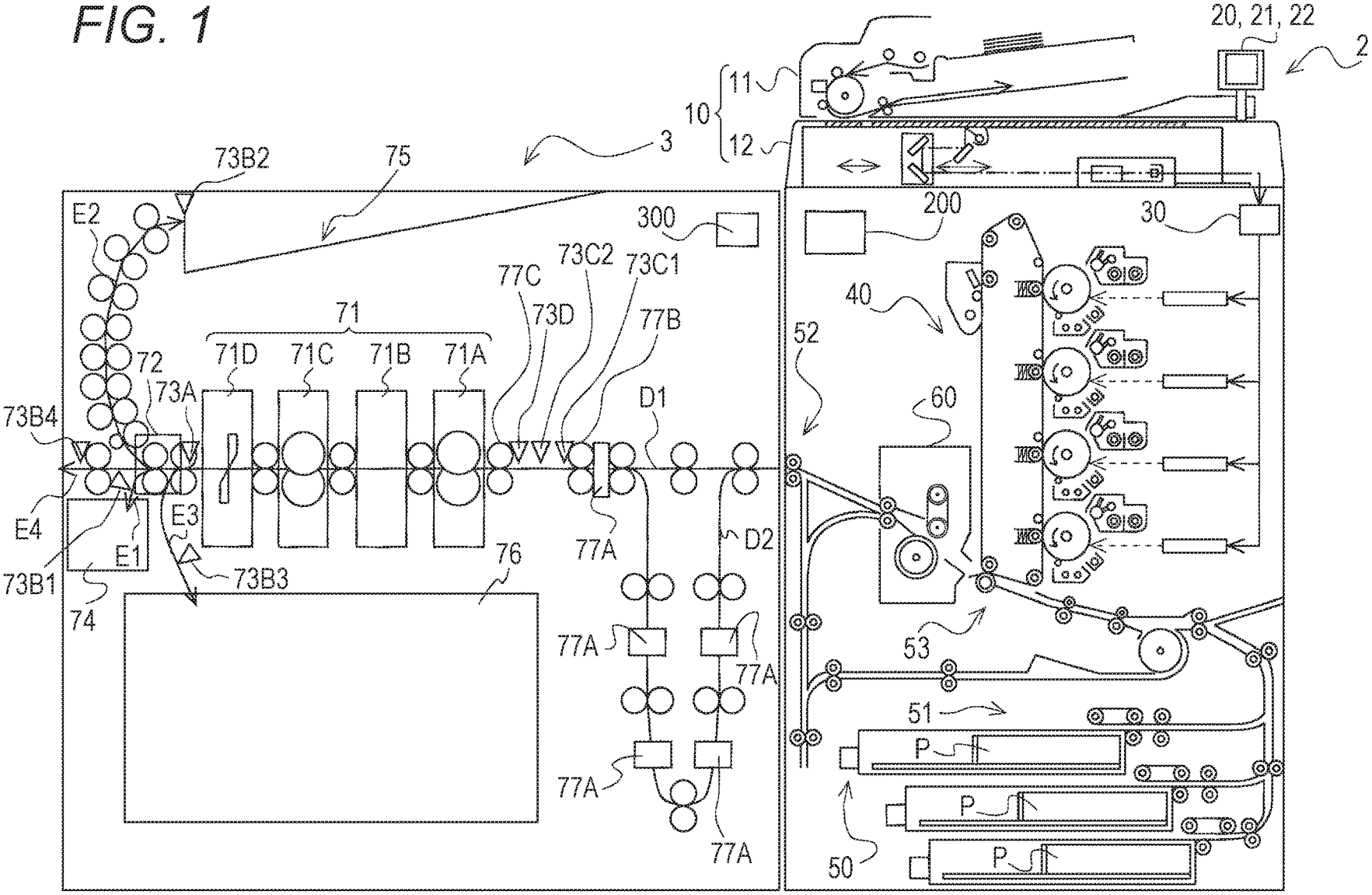
FIG. 1 is a diagram showing an example configuration of an entire image forming system according to an embodiment of the present disclosure.

FIG. 1 is a diagram showing an example configuration of an entire image forming system according to an embodiment of the present disclosure. As shown in FIG. 1, an image forming system has a configuration in which a post-processing apparatus 3 is connected to the downstream side of an image forming apparatus 2. The post-processing apparatus 3 includes a post-processor 71 and a controller 300, and performs various kinds of post-processing on a paper sheet P being conveyed from the image forming apparatus 2. The post-processing apparatus 3 will be described later in detail. The image forming apparatus 2 is a color image forming apparatus of an intermediate transfer type using an electrophotographic process technology. In the image forming apparatus 2, a vertical tandem system is adopted so that photosensitive drums corresponding to the four colors of YMCK are arranged in series in the conveying direction of an intermediate transfer belt, which is a vertical direction, and toner images in the respective colors are transferred onto the intermediate transfer belt by one operation. Specifically, the image forming apparatus 2 performs a primary transfer of toner images in the respective colors of Y (yellow), M (magenta), C (cyan), and K (black) from the photosensitive drums onto the intermediate transfer belt, and overlaps the toner images in the four colors on one another on the intermediate transfer belt. After that, the image forming apparatus 2 performs a secondary transfer of the toner images onto a paper sheet P, to form an image.

The image forming apparatus 2 includes an image reading unit 10, an operation display unit 20, an image processing unit 30, an image forming unit 40, a sheet conveying unit 50, a fixing unit 60, and a controller 200. The image reading unit 10 includes an automatic document feeder 11 and a document image scanner 12. The automatic document feeder 11 is referred to as an auto document feeder (ADF). The automatic document feeder 11 conveys a document placed on a document tray with a conveyance mechanism, to send the document to the document image scanner 12. The automatic document feeder 11 is capable of consecutively reading images of a large number of documents placed on the document tray. The automatic document feeder 11 is capable of reading both sides of each document with a sheet reversing mechanism when reading images of a large number of documents in a row. The document image scanner 12 optically scans a document conveyed onto a contact glass from the automatic document feeder 11 or a document placed on the contact glass. The document image scanner 12 reads a document image formed on a document by gathering light reflected from the document due to optical scanning onto the light receiving surface of a CCD sensor. In accordance with the results of the reading performed by the document image scanner 12, the image reading unit 10 generates input image data of the document image. The input image data is supplied to the image processing unit 30, and the image processing unit 30 performs predetermined image processing.

The operation display unit 20 is formed with a liquid crystal display (LCD) having a touch panel, for example, and functions as a display unit 21 and an operation unit 22. The display unit 21 displays various operation screens, conditions of images, operating conditions of respective functions, or the like, in accordance with display control signals that are input from the controller 200. The operation unit 22 includes various operation keys such as a numeric keypad and a start key. The operation unit 22 accepts various input operations from the user, to generate various kinds of operation signals. The operation signals are output to the controller 200.

The image processing unit 30 includes a circuit that performs digital image processing on input image data in accordance with initial settings or user settings. For example, under the control of the controller 200, the image processing unit 30 performs tone correction on the input image data, in accordance with a tone correction table in which tone correction data is set. In addition to the tone correction, the image processing unit 30 also performs various correction processes such as color correction and shading correction, a compression process, and the like, on the input image data. The image forming unit 40 performs various kinds of processing based on the input image data subjected to the various kinds of digital image processing. The image forming unit 40 forms images with the respective single-color toners of the Y component, the M component, the C component, and the K component, based on the input image data. The image forming unit 40 includes photosensitive drums, charging devices, exposure devices, developing devices, and an intermediate transfer device. The surface of each photosensitive drum is uniformly charged by corona discharge of each corresponding charging device. As the exposure devices emit laser lights corresponding to the images of the respective color components onto the photosensitive drums, electrostatic latent images of the respective color components are formed on the surfaces of the photosensitive drums. The developing devices supply the toners of the respective color components onto the surfaces of the photosensitive drums, to make the electrostatic latent images visible and form toner images. The toner images are transferred onto a paper sheet P by the intermediate transfer device.

The fixing unit 60 applies heat and pressure to the toner image transferred onto the paper sheet P, to fix the toner image to the paper sheet P. The sheet conveying unit 50 includes a sheet feeder unit 51, a sheet ejecting unit 52, and a conveyance path unit 53. The sheet feeder unit 51 stores paper sheets P of respective types that are set beforehand in accordance with the basis weights, the sizes, and the like of the paper sheets P. The conveyance path unit 53 conveys a paper sheet P stored in the sheet feeder unit 51, or a paper sheet P having an image formed on the front or back surface thereof. The sheet ejecting unit 52 ejects each paper sheet P having an image formed thereon out of the apparatus.

The post-processing apparatus 3 includes not only the post-processor 71 and the controller 300, but also a conveyance path switching unit 72, a jam detection sensor 73A, an ejected sheet sensor 73B1, an ejected sheet sensor 73B2, an ejected sheet sensor 73B3, an ejected sheet sensor 73B4, a bend detection sensor 73C1, a bend detection sensor 73C2, a positioning sensor 73D, a card tray 74, a purge tray 75, a waste box 76, aligning units 77A, steering rollers 77B, registration rollers 77C, a conveyance path D1, an ejected sheet conveyance path E1, an ejected sheet conveyance path 112, an ejected sheet conveyance path E3, and an ejected sheet conveyance path E4. On the upstream side of the post-processor 71, the bend detection sensor 73C1, the bend detection sensor 73C2, the positioning sensor 73D, the aligning units 77A, the steering rollers 77B, the registration rollers 77C, and the conveyance path D1 are disposed. On the downstream side of the post-processor 71, the conveyance path switching unit 72, the jam detection sensor 73A, the ejected sheet sensor 73B1, the ejected sheet sensor 73B2, the ejected sheet sensor 73B3, the ejected sheet sensor 73B4, the ejected sheet conveyance path E1, the ejected sheet conveyance path E2, the ejected sheet conveyance path E3, and the ejected sheet conveyance path E4 are disposed. The purge tray 75 is disposed above the post-processor 71. The waste box 76 is disposed below the post-processor 71. Hereinafter, the ejected sheet sensor 73B1, the ejected sheet sensor 73B2, the ejected sheet sensor 73B3, and the ejected sheet sensor 73B4 will also be collectively referred to as the ejected sheet sensors 73B, where appropriate.

A long sheet conveyance path D2 is attached to the conveyance path D1. The long sheet conveyance path D2 functions as a buffer when conveying a long paper sheet. The aligning units 77A are disposed in the long sheet conveyance path D2. The aligning units 77A each include a pair of CD aligning members (not shown) that face each other in a direction orthogonal to the direction of conveyance of paper sheets P, a CD aligning motor (not shown) that reciprocates the CD aligning members in the direction orthogonal to the direction of conveyance of paper sheets P, and a drive mechanism (not shown). The aligning units 77A each reciprocate the CD aligning members in contact with both ends of a paper sheet P, to align the positions of both ends of the paper sheet P. Note that one of the aligning units 77A is disposed in the conveyance path D1.

The bend detection sensor 73C1 is formed with a pair of transmission-type sensors arranged in the width direction of paper sheets P, and detects the times of passage of two portions of the top edge of a paper sheet P with the respective transmission-type sensors. The bend detection sensor 73C2 is the same as the bend detection sensor 73C1. Hereinafter, the bend detection sensor 73C1 and the bending detection sensor 73C2 will also be collectively referred to as the bend detection sensors 73C, where appropriate. The steering rollers 77B are disposed on the upstream side of the post-processor 71, and are a pair of rollers disposed along the direction orthogonal to the direction of conveyance of the paper sheet P. Specifically, the steering rollers 77B are disposed at respective positions facing each other in the width direction of paper sheets P. In accordance with a result of detection conducted by the bend detection sensor 73C1, the amounts of rotation of the respective steering rollers 77B are driven and controlled in the same phase so as to eliminate the difference between the times of passage of two positions of the top edge of a paper sheet P detected by the bend detection sensor 73C1. In this manner, the steering rollers 77B cause a difference in the conveyance velocity, to adjust the bend of the paper sheet P with respect to the direction of conveyance of the paper sheet P. In accordance with a result of detection performed by the bend detection sensor 73C2, the steering rollers 77B further adjust the bend of the paper sheet P with respect to the direction of conveyance of the paper sheet P.

The registration rollers 77C align the top edge of a paper sheet P by bringing the top edge of the paper sheet P into contact therewith while the rotational drive is suspended. The registration rollers 77C then form bending (a loop) in a longitudinal direction of the paper sheet P, to correct the bend of the paper sheet P with respect to the direction of conveyance of the paper sheet P. The positioning sensor 73D is disposed on the upstream side of the post-processor 71, and detects a paper sheet P being conveyed into the post-processor 71. In accordance with a result of the detection performed by the positioning sensor 73D, the post-processor 71 determines the position of the paper sheet P for the time of cutting of the paper sheet P. Specifically, an image of a product or a partition sheet is printed on a paper sheet P conveyed from the sheet ejecting unit 52 of the image forming apparatus 2 to the conveyance path D1. The post-processor 71 is disposed on the downstream side of the image forming apparatus 2 that forms images of a product and a partition sheet. The post-processor 71 cuts the paper sheet P into a plurality of sheets, and forms the product and the partition sheet. In other words, the controller 300 causes the post-processor 71 to cut a paper sheet P into a product formed on part of the paper sheet P and a partition sheet formed on the other part of the paper sheet P. The post-processor 71 includes at least one of post-processing modules 71A, 71B, 71C, and 71D. Each of the post-processing modules 71A through 71D is detachably attached to the post-processing apparatus 3, and the layout thereof can be changed as appropriate. For example, depending on the product, at least one of the post-processing modules 71A through 71D can be detached from the post-processing apparatus 3.

The post-processing module 71A includes a slitter that cuts a paper sheet P in the direction of conveyance, which is the sub scanning direction. The post-processing module 71A cuts off the top and bottom margins, for example, as first margins of the paper sheet P. The slitter of the post-processing module 71A functions as a top/bottom slitter when cutting off the top and bottom margins. The post-processing module 71B may include a scoring unit that scores the paper sheet P cut by the post-processing module 71A, for example. The post-processing module 71B may include a perforating unit that forms perforations in the paper sheet P cut by the post-processing module 71A. However, in a case where no processing such as scoring or perforating is not to be performed on the paper sheet P, only a guide plate, instead of the post-processing module 71B, should be provided along the conveyance path D1. The post-processing module 71C includes a slitter that cuts the paper sheet P in the direction of conveyance. The position at which the slitter of the post-processing module 71C is disposed differs from the position at Which the slitter of the post-processing module 71A is disposed. The post-processing module 71C cuts off a margin between products or partition sheets as a second margin of the paper sheet P, for example. The slitter of the post-processing module 71C functions as a slit-cut slitter when cutting off a margin between products or partition sheets. The post-processing module 71D includes a guillotine cutter that cuts the paper sheet P cut by the post-processing module 71C, in a direction orthogonal to the direction of conveyance, which is the main scanning direction. The paper sheet P cut in the main scanning direction by the post-processing module 71D is conveyed as a product, a partition sheet, or chipped paper. Cutting a paper sheet P in a direction parallel to the direction of conveyance is called the feed direction (FD) cutting, and cutting a paper sheet P in a direction orthogonal to the direction of conveyance is called the cross direction (CD) cutting. The FD cutting is performed by the post-processing modules 71A and 71C, and the CD cutting is performed by the post-processing module 71D.

The conveyance path switching unit 72 switches the conveyance path to one of the ejected sheet conveyance paths E1 through E4, depending on the conveyance destination of the paper sheet P that has just passed through the post-processor 71. The ejected sheet conveyance path E1 conveys a product or a partition sheet to the card tray 74. The ejected sheet conveyance path E2 conveys a product or a partition sheet to the purge tray 75. The ejected sheet conveyance path E3 conveys chipped paper to the waste box 76. The ejected sheet conveyance path E4 conveys a product or a partition sheet to another processing apparatus connected to the downstream side of the post-processing apparatus 3. The jam detection sensor 73A is disposed between the post-processing module 71D and the conveyance path switching unit 72, and detects a product or a partition sheet being ejected from the post-processing module 71D. In a case where the jam detection sensor 73A does not detect a product or a partition sheet even after a preset time has passed, the controller 300 determines that a jam has occurred in the conveyance path D1.

The card tray 74 is the ejection destination of the ejected sheet conveyance path E1 to which the conveyance path is switched by the conveyance path switching unit 72, and may be formed in such a size that can accommodate products and partition sheets. Products and partition sheets conveyed through the ejected sheet conveyance path E1 can be loaded into the card tray 74. The controller 300 performs control to convey products and partition sheets to the card tray 74 through the ejected sheet conveyance path E1. The ejected sheet sensor 73B1 is disposed in the ejected sheet conveyance path E1. With this arrangement, the controller 300 is capable of detecting whether a product or a partition sheet conveyed in the ejected sheet conveyance path E1 has been ejected to the card tray 74 with certainty, on the basis of a result of the detection performed by the ejected sheet sensor 73B1.

The purge tray 75 is the ejection destination of the ejected sheet conveyance path E2 to which the conveyance path is switched by the conveyance path switching unit 72, and, in addition to products and partition sheets, paper sheets cut to a larger size than the products and the partition sheets can be loaded into the purge tray 75. The controller 300 performs control to convey products and partition sheets to the purge tray 75 through the ejected sheet conveyance path E2. The ejected sheet sensor 73B2 is disposed in the ejected sheet conveyance path E2. With this arrangement, the controller 300 is capable of detecting whether a product or a partition sheet conveyed through the ejected sheet conveyance path E2 has been ejected to the purge tray 75 with certainty, on the basis of a result of the detection performed by the ejected sheet sensor 73B2.

The waste box 76 is the ejection destination of the ejected sheet conveyance path E3 to which the conveyance path is switched by the conveyance path switching unit 72. Chipped paper such as the first margins, the second margins, and the margins between products cut off by the post-processor 71 are stored in the waste box 76. The controller 300 performs control to cause the ejected sheet conveyance path E3 to convey various kinds of chipped paper cut off by the post-processor 71 to the waste box 76. The ejected sheet sensor 73B3 is disposed in the ejected sheet conveyance path 113. With this arrangement, the controller 300 is capable of detecting whether chipped paper conveyed through the ejected sheet conveyance path E3 has been ejected to the waste box 76 with certainty, on the basis of a result of the detection performed by the ejected sheet sensor 73B3. In a case where the waste box 76 is disposed directly below the post-processor 71, the chipped paper is dropped directly into the waste box 76. Therefore, the ejected sheet conveyance path E3 is not provided, and the ejected sheet sensor 73B3 is not necessary either.

In a case where a processing apparatus is connected to the downstream side of the post-processing apparatus 3, the ejected sheet conveyance path E4 conveys a product or a partition sheet to the processing apparatus that is the ejection destination of the ejected sheet conveyance path E4 to which the conveyance path is switched by the conveyance path switching unit 72. The ejected sheet sensor 73B4 is disposed in the ejected sheet conveyance path E4. With this arrangement, the controller 300 is capable of detecting whether a product or a partition sheet conveyed through the ejected sheet conveyance path E4 has been ejected to the processing apparatus with certainty, on the basis of a result of the detection performed by the ejected sheet sensor 73B4.

Figure 2:
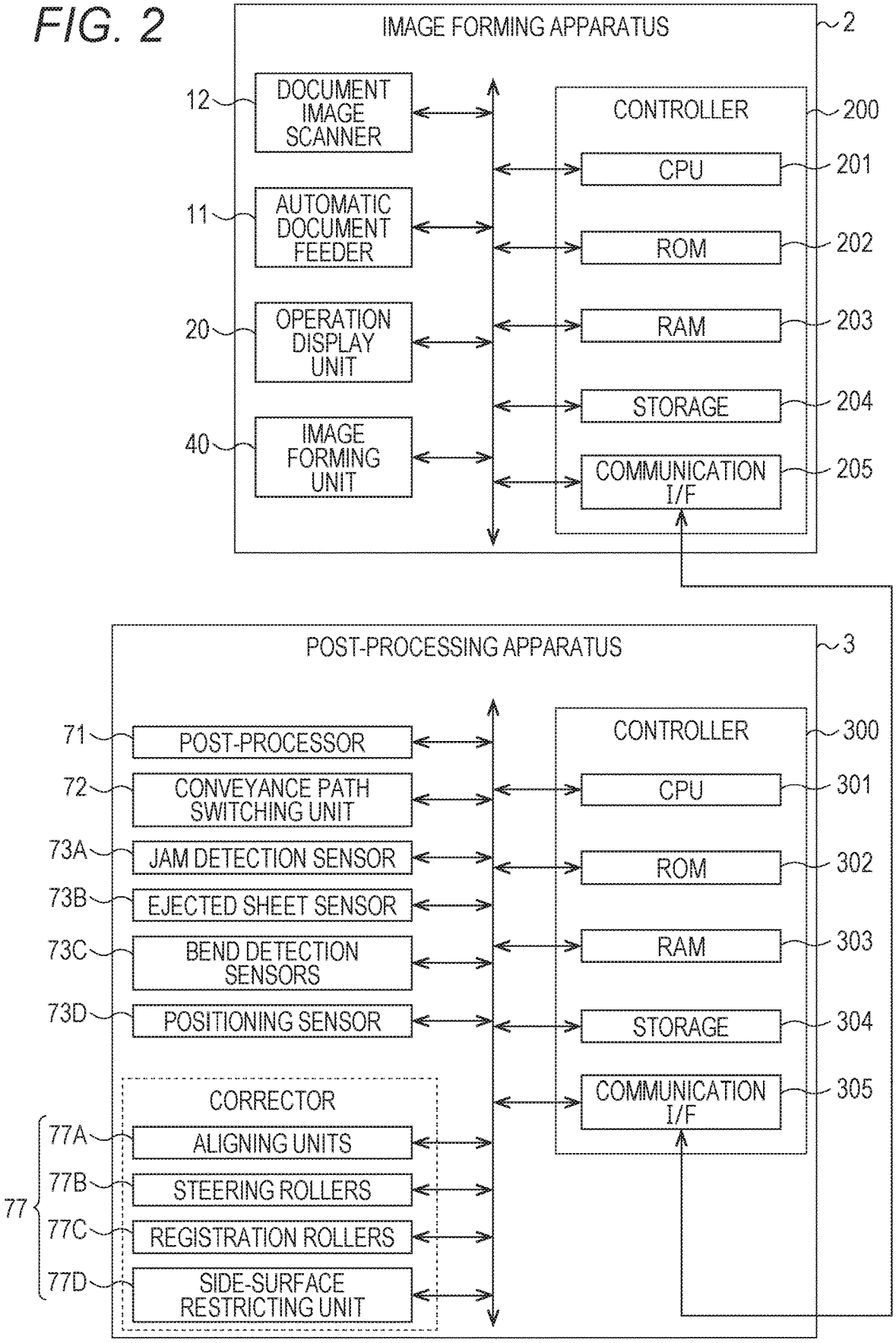
FIG. 2 is a diagram showing the principal part of the control system of the image forming system according to the embodiment of the present disclosure.

FIG. 2 is a diagram showing the principal part of the control system of the image forming system according to the embodiment of the present disclosure. As shown in FIG. 2, the controller 200 of the image forming apparatus 2 includes a CPU 201, a ROM 202, a RAM 203, a storage 204, and a communication interface 205. The automatic document feeder 11, the document image scanner 12, the operation display unit 20, the image forming unit 40, and the controller 200 in the image forming apparatus 2 are connected via a bus. The CPU 201 is used as a processor that controls operations of the automatic document feeder 11, the operation display unit 20, the image forming unit 40, and the like in the image forming apparatus 2. For example, the CPU 201 controls an image formation process to be performed by the image forming unit 40, in accordance with a print instruction issued from the user via the operation display unit 20. The ROM 202 is used as a nonvolatile memory, and stores programs or data or the like required for the CPU 201 to operate. The RAM 203 is used as a volatile memory, and temporarily stores data necessary for each process to be performed by the CPU 201. The storage 204 is formed with a hard disk drive (HDD), for example, and stores programs for the CPU 201 to control the image forming apparatus 2, an OS (Operating System), and data. Some of the programs and data stored in the storage 204 are also stored in the ROM 202. The storage 204 is used as an example of a computer-readable non-transitory recording medium storing a program to be executed by the CPU 201. The storage 204 is not necessarily an HDD, and may be a recording medium such as a solid state drive (SSD) or a Blu-ray Disc (registered trademark), for example. The communication interface 205 is formed with a network interface card (NIC), a modem, or the like. The communication interface 205 establishes a connection with the post-processing apparatus 3 and an external terminal or the like (not shown), and transmits and receives various kinds of data.

Meanwhile, as shown in FIG. 2, the controller 300 of the post-processing apparatus 3 includes a CPU 301, a ROM 302, a RAM 303, a storage 304, and a communication interface 305. The post-processor 71, the conveyance path switching unit 72, and the controller 300 in the post-processing apparatus 3 are connected via a bus. The CPU 301 is used as a processor that controls operations of the post-processor 71, the conveyance path switching unit 72, and the like in the post-processing apparatus 3. For example, the CPU 301 has a function of conducting the cutting process to be performed by the post-processor 71, and the switching process and the like to be performed by the ejected sheet conveyance paths E1 through E4 for paper sheets P. The ROM 302 is used as a nonvolatile memory; and stores programs or data or the like required for the CPU 301 to operate. The RAM 303 is used as a volatile memory, and temporarily stores data necessary for each process to be performed by the CPU 301. The storage 304 is formed with an HDD, for example, and stores programs, an OS, and data for the CPU 301 to control the post-processing apparatus 3. Some of the programs and data stored in the storage 304 are also stored in the ROM 302. The storage 304 is used as a computer-readable non-transitory recording medium storing a program to be executed by the CPU 301. The storage 304 is not necessarily an HDD, and may be a recording medium such as an SSD or a Blu-ray Disc, for example. The communication interface 305 is formed with an NIC, a modem, or the like. The communication interface 305 establishes a connection with the image forming apparatus 2 and an external terminal or the like (not shown), and transmits and receives various kinds of data. If the post-processing apparatus 3 is disposed in line with the image forming apparatus 2, various functions that are normally executed by the post-processing apparatus 3 may be executed with the CPU 201, the ROM 202, the RAM 203, and the storage 204 of the image forming apparatus 2. Therefore, the post-processing apparatus 3 may have a configuration that excludes the CPU 301, the ROM 302, the RAM 303, and the storage 304.

Although not shown in FIG. 1, the post-processing apparatus 3 may include a side-surface restricting unit 77D. The side-surface restricting unit 77D is disposed on the upstream side of the post-processor 71 and in the conveyance path D1 and the long sheet conveyance path D2. The side-surface restricting unit 77D includes a side-surface restricting plate, an oblique belt, and a suction duct (all not shown). The side-surface restricting unit 77D attracts paper sheets P to the oblique belt with the suction duct, and aligns the positions of the side edges of paper sheets P by sending out the paper sheets Pin an oblique direction while bringing the side edges of the paper sheets P into contact with the side-surface restricting plate with the oblique belt. Hereinafter, the aligning units 77A, the steering rollers 77B, the registration rollers 77C, and the side-surface restricting unit 77D will also be collectively referred to as the corrector 77, where appropriate.

Figure 3:
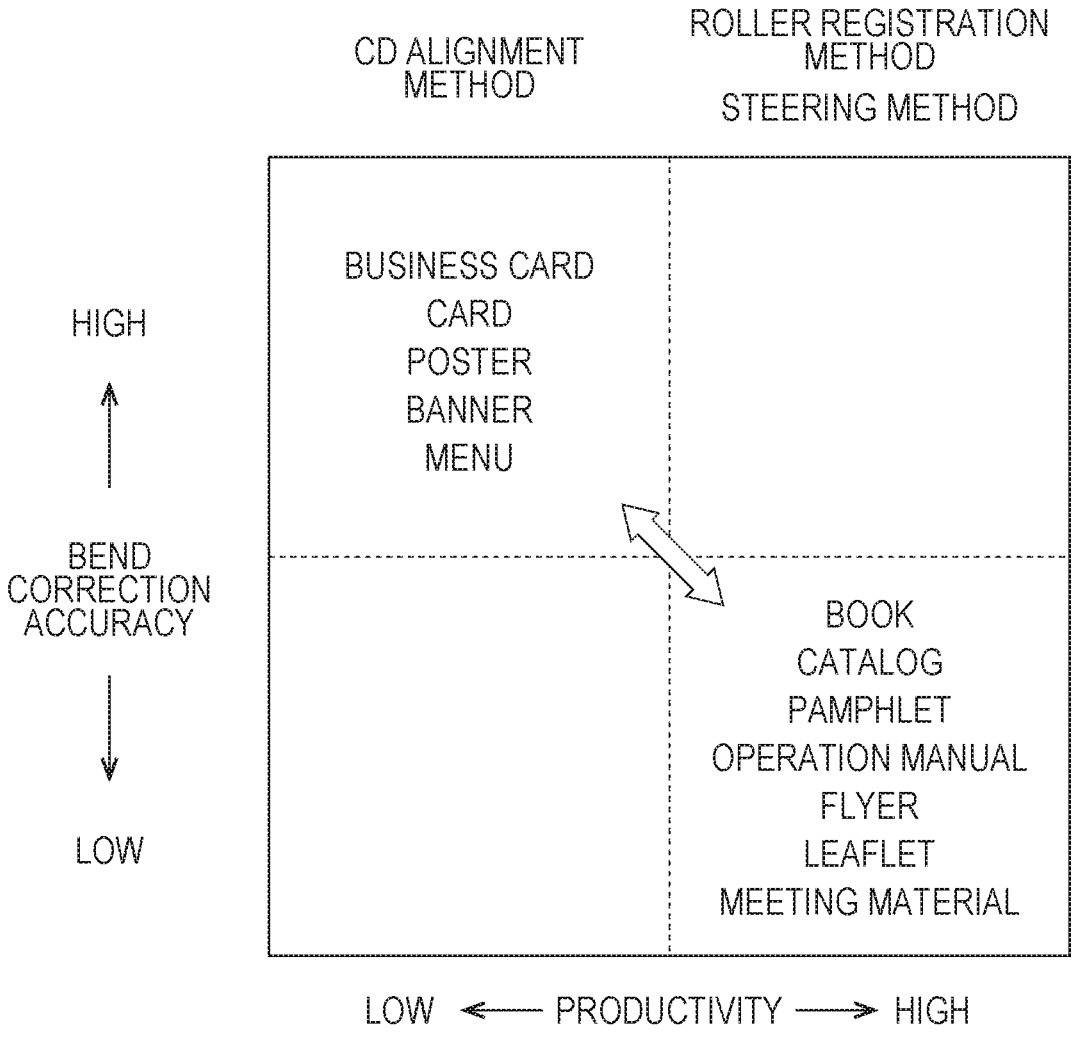
FIG. 3 is a diagram showing an example of the relationship between a product, productivity, and bend correction accuracy in the embodiment of the present disclosure.

FIG. 3 is a diagram showing an example of the relationship between the product, productivity, and bend correction accuracy in the embodiment of the present disclosure. As shown in FIG. 3, in a case where the product is a business card, a general-purpose card, a poster, a banner, and/or a menu, the accuracy required for bend correction is high, but the required productivity is low. The bend correction method that provides a high bend correction accuracy but provides a low productivity is a CD alignment method. On the other hand, in a case where the product is a book, a catalog, a brochure, an operation manual, a flyer, a leaflet, and/or a meeting material, the accuracy required for bend correction is low, but the required productivity is high. The bend correction method that provides a high productivity but provides a low bend correction accuracy is a roller registration method and/or a steering method. The CD alignment method is a method by which the positions of both edges of the paper sheets P are aligned by the aligning units 77A, as described above. The roller registration method is a method for forming bending (a loop) in a longitudinal direction of a paper sheet P by bringing the top edge of the paper sheet P into contact therewith while the rotational drive of the registration rollers 77C is suspended, and thus correcting the bend of the paper sheet P with respect to the direction of conveyance of the paper sheet P, as described above. Meanwhile, the steering method is a method for adjusting the bend of a paper sheet P with respect to the direction of conveyance of the paper sheet P so as to eliminate the difference between the times of passage of two portions of the top edge of the paper sheet P detected by the bend detection sensors 73C, using the steering rollers 77B disposed at respective positions facing each other in the width direction of paper sheets P, as described above.

FIG. 4 is a diagram for explaining the features of the respective methods for bend correction according to the embodiment of the present disclosure. In the case of the roller registration method, when the rigidity of a paper sheet P is low, or the rigidity of a paper sheet P is lower than a predetermined value, the bend correction accuracy is high. When the rigidity of a paper sheet P is high, or the rigidity of a paper sheet P is equal to or higher than the predetermined value, the bend correction accuracy is tow. By the roller registration method, a paper sheet P is physically brought into contact with the registration rollers 77C that are not rotating. In view of this, the roller registration method is advantageous for thin paper. However, a paper sheet P having a basis weight of 135 g/m$^2$ or greater does not form a loop at the registration rollers 77C, and therefore, the bend correcting function is degraded. In the case of the steering method, when the rigidity of a paper sheet P is low, or the rigidity of a paper sheet P is lower than a predetermined value, the bend correction accuracy is high, as long as the size of the paper sheet P is large or small. However, if the paper sheet. P is a long paper sheet, the bend correction accuracy is low. Further, in the case of the steering method, when the rigidity of a paper sheet P is high, or the rigidity of a paper sheet. P is equal to or higher than the predetermined value, the bend correction accuracy is high, as long as the size of the paper sheet P is large or small. However, if the paper sheet P is a long paper sheet, the bend correction accuracy is low. The steering method is advantageous for paper sheets P having stiffness, and the bend amount of a paper sheet P can be adjusted by the steering method. The steering method depends on the bend detection performance of the bend detection sensors 73C, and it is difficult to cope with a long paper sheet P by the steering method. By the steering method, the correction time required for bend correction is short, and the bend correction accuracy is medium. In the case of the CD alignment method, when the rigidity of a paper sheet P is low, or the rigidity of a paper sheet P is lower than a predetermined value, the bend correction accuracy is high. When the rigidity of a paper sheet P is high, or the rigidity of a paper sheet P is equal to or higher than the predetermined value, the bend correction accuracy is high, as long as the size of the paper sheet P is large or small. Accordingly, a high bend correction accuracy is achieved when the size of the paper sheet P is large or the paper sheet. P is a long paper sheet. The CD alignment method is advantageous for paper sheets P having stiffness, and paper sheets P of a size aligned at the long side is advantageous in achieving a high bend correction accuracy. By the CD alignment method, conveyance of paper sheets P is suspended, and therefore, the productivity is low. Note that, by the CD alignment method, the correction time required for bend correction is long, and the bend correction accuracy is high.

In other words, the post-processing apparatus 3 is capable of implementing a plurality of kinds of bend correction methods, and selectively uses a bend correction method, depending on the number of products and the properties of the correction target, such as the sheet width and the paper type. The time required for bend correction, and the bend correction accuracy vary among the respective bend correction methods. Thus, a bend correction method is selectively used in accordance with the properties of the correction target. However, for the properties of the same correction target, an optimum bend correction method is not selected by taking other factors into consideration. Depending on a selected bend correction method, the time required for bend correction might become a bottleneck, which will tower the overall productivity.

Therefore, in the post-processing apparatus 3 capable of implementing a plurality of kinds of bend correction methods, an optimum bend correction method is selected in accordance with the relationship among the bend correction accuracies obtained through bend correction performed by the respective bend correction methods, the correction times required for bend correction by the respective bend correction methods, and the post-processing times required for performing post-processing after the bend correction. In this manner, a decrease in the overall productivity is prevented, while the specified requirements are satisfied so as to fix a post-processing positional accuracy within an allowable range. Note that the first requirement in post-processing is that the paper sheet P conveyed to the post-processor 71 is not oblique. Specifically, to perform bend correction on a paper sheet P before the paper sheet P is conveyed to the post-processor 71, the corrector 77 that is in a stage before the post-processor 71 secures a high bend correction accuracy. Accordingly, the bend correction accuracy is included in part of the post-processing positional accuracy. Further, the post-processing includes cutting and the like. Therefore, it is necessary to accurately determine the position of a paper sheet P. In view of this, the post-processor 71 performs the post-processing, on the basis of a result of detection performed by the positioning sensor 73D.

In other words, the post-processing apparatus 3 that performs post-processing on a paper sheet P conveyed from the previous stage side includes: the corrector 77 that performs bend correction on the paper sheet P, in accordance with one of a plurality of bend correction methods; the post-processor 71 that performs post-processing on the paper sheet P subjected to the bend correction performed by the corrector 77; and the controller 300 that selects one of the plurality of bend correction methods, on the basis of the bend correction accuracy corresponding to the product to be created through the post-processing performed by the post-processor 71, and the productivity of the product. From among the bend correction methods, the controller 300 selects a method for reducing the difference between the post-processing time required for the post-processor 71 to perform post-processing and the correction time required for the corrector 77 to perform bend correction on the paper sheet P. Note that the productivity of the product varies depending on the post-processing time and the correction time.

Specifically, in a case where the post-processing time is equal to or longer than a threshold time, the controller 300 selects the CD alignment method from among the bend correction methods. In a case where the post-processing time is shorter than the threshold time, and the rigidity of the paper sheet P is low or the rigidity of the paper sheet P is lower than a predetermined value, the controller 300 selects the roller registration method from among the bend correction methods. In a case where the post-processing time is shorter than the threshold time, and the rigidity of the paper sheet P is high or the rigidity of the paper sheet P is equal to or higher than the predetermined value, the controller 300 selects the steering method from among the bend correction methods. In a case where the post-processing time is equal to or longer than the threshold time, and the paper sheet P is a long paper sheet, or in a case where a short side of the paper sheet P is the leading edge of the paper sheet P being conveyed to the post-processor 71, the controller 300 selects the CD alignment method. In a case where the product is a booklet, the controller 300 selects the steering method. In a case where the product is a business card, the controller 300 selects the CD alignment method.

In a case where bend correction is to be performed on the paper sheet P, and the bend amount of the image printed on the paper sheet P is to be corrected, the controller 300 selects the steering method. By the steering method, the rotational velocity of each of the pair of steering rollers 77B is adjusted in accordance with the bend amount of the image printed on the paper sheet P. Note that the controller 300 selects one of the bend correction methods, in accordance with the bend correction accuracy or the productivity of the product, whichever has the higher priority level.

Figure 5:
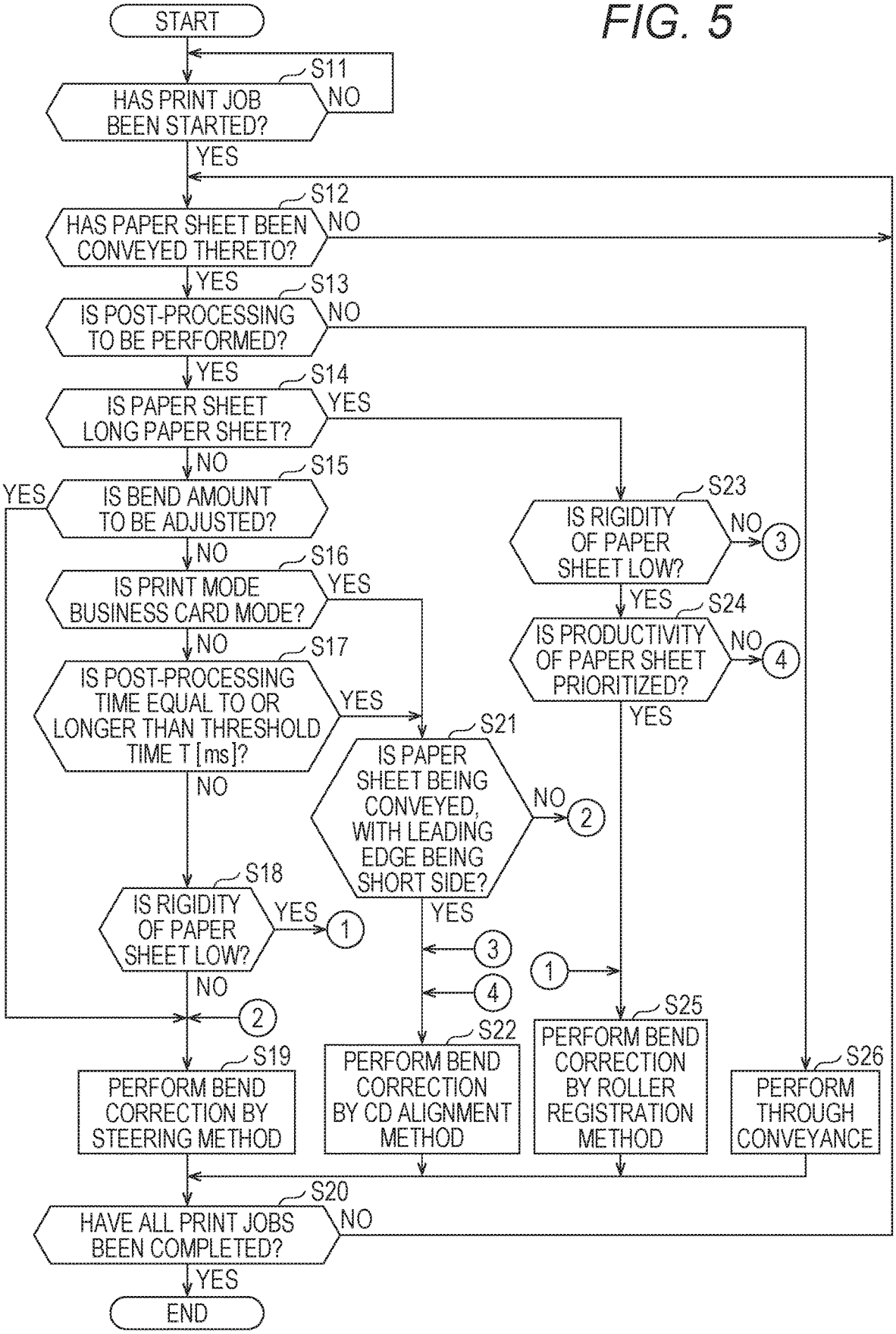
FIG. 5 is a flowchart for explaining an example of control to be performed a post-processing apparatus according to the embodiment of the present disclosure.

FIG. 5 is a flowchart for explaining an example of control to be performed the post-processing apparatus 3 according to the embodiment of the present disclosure. In step S11, the controller 300 determines whether a print job has been started. If determining that a print job has been started (step S11: Y), the controller 300 moves on to the processing in step S12. If determining that a print job has not been started (step S11: N), the controller 300 continues the processing in step S11. In step S12, the controller 300 determines whether a paper sheet P has been conveyed thereto. If determining that a paper sheet P has been conveyed thereto (step S12: Y), the controller 300 moves on to the processing in step S13. If determining that any paper sheet P has not been conveyed thereto (step S12: N), the controller 300 continues the processing in step S12. In step S13, the controller 300 determines whether post-processing is to be performed. If determining that post-processing is to be perforated (step S13: Y), the controller 300 moves on to the processing in step S14. If determining that post-processing is not to be performed (step S13; N), the controller 300 moves on to the processing in step S26. In step S26, through conveyance is performed, or the paper sheet P is conveyed without being subjected to post-processing, and the controller 300 then moves on to the processing in step S20.

In step S14, the controller 300 determines whether the paper sheet P is a long paper sheet. If determining that a paper sheet P is a long paper sheet (step S14: Y), the controller 300 moves on to the processing in step S23. In step S23, the controller 300 determines whether the rigidity of the paper sheet P is low. If determining that the rigidity of the paper sheet P is low, or the rigidity of the paper sheet P is tower than a predetermined value (step S23; Y), the controller 300 moves on to the processing in step S24. If determining that the rigidity of the paper sheet P is not low, or the rigidity of the paper sheet. P is high, or the rigidity of the paper sheet P is equal to or higher than the predetermined value (step S23; N), the controller 300 moves on to the processing in step S22. In step S24, the controller 300 determines whether to prioritize the productivity of the paper sheet P. If determining to prioritize the productivity of the paper sheet P (step S24; Y), the controller 300 moves on to the processing in step S25. In step S25, the controller 300 conducts bend correction by the roller registration method, and moves on to the processing in step S20. If determining not to prioritize the productivity of the paper sheet P (step S24: N), the controller 300 moves on to the processing in step S22. If determining that the paper sheet P is not a long paper sheet in step S14 (step S14: N), on the other hand, the controller 300 moves on to the processing in step S15.

In step S15, the controller 300 determines Whether the bend amount is to be adjusted. If determining that the bend amount is to be adjusted (step S15; Y), the controller 300 moves on to the processing in step S19. In step S19, the controller 300 conducts bend correction by the steering method, and moves on to the processing in step S20. If determining that the bend amount is not to be adjusted (step S15: N), the controller 300 moves on to the processing in step S16. In step S16, the controller 300 determines whether the print mode is a business card mode. If determining that the print mode is the business card mode (step S16; Y), the controller 300 moves on to the processing in step S21. In step S21, the controller 300 determines whether the leading edge of the paper sheet P being conveyed is a short side. If determining that the leading edge of the paper sheet P being conveyed is a short side (step S21; Y), the controller 300 moves on to the processing in step S22. In step S22, the controller 300 conducts bend correction by the CD alignment method, and moves on to the processing in step S20. If determining that the leading edge of the paper sheet P being conveyed is not a short side (step S21: N), the controller 300 moves on to the processing in step S19. If determining that the print mode is not the business card mode in step S16 (step S16: N), on the other hand, the controller 300 moves on to the processing in step S17.

In step S17, the controller 300 determines whether the post-processing time is equal to or longer than a threshold time T [ms]. Specifically, a time that is equal to or longer than the time necessary for the CD alignment method in the step before the post-processing is set as the threshold time T [ms]. With such a setting, even if the post-processing time required in the previous step on the downstream side is long, it is possible to allot a long time to the next step on the upstream side without lowering the overall productivity, as long as the post-processing time is equal to or longer than the threshold time T [ms]. Accordingly, the CD alignment method can be selected as the method corresponding to the next step on the upstream side. The threshold time T [ms] is also an index to be used in determining whether the post-processing is high-speed processing or whether the post-processing is low-speed processing. For example, in a case where post-processing is to be performed on a cover or an inside page of a booklet, the post-processing needs to be high-speed processing, and a medium-level bend correction accuracy is required. On the other hand, in the case of post-processing such as business card cutting, the post-processing needs to be low-speed processing, and a high bend correction accuracy is required. If determining that post-processing time is equal to or longer than the threshold time T [ms] (step S17: Y), the controller 300 moves on to the processing in step S21. If determining that the post-processing time is neither equal to nor higher than the threshold time T [ms] (step S17; N), or if determining that the post-processing time is shorter than the threshold time T [ms] (step S17; N), the controller 300 moves on to the processing in step S18.

In step S18, the controller 300 determines whether the rigidity of the paper sheet P is low. If determining that the rigidity of the paper sheet P is low, or the rigidity of the paper sheet P is tower than a predetermined value (step S18; Y), the controller 300 moves on to the processing in step S25. If determining that the rigidity of the paper sheet P is not low, or the rigidity of the paper sheet. P is high, or the rigidity of the paper sheet P is equal to or higher than the predetermined value (step S18; N), the controller 300 moves on to the processing in step S19. In step S20, the controller 300 determines whether all the print jobs have been completed. If determining that all the print jobs have been completed (step S20: Y), the controller 300 ends the process. If determining that not all the print jobs have been completed (step S20: N), the controller 300 returns to the processing in step S12.

As described above, according to this embodiment, a bend correction method that can reduce the difference between the post-processing time and the correction time is selected from among a plurality of bend correction methods. Accordingly, it is possible to shorten the waiting time between the step of correcting the bend of a paper sheet P and the step of performing post-processing on the paper sheet P. Thus, it is possible to reduce the decrease in the overall productivity, while improving the bend correction accuracy for paper sheets P.

Further, according to this embodiment, in a case where the post-processing time is equal to or longer than the threshold time, the CD alignment method is selected from among the plurality of bend correction methods. According to the CD alignment method, the correction time is long, but the bend correction accuracy is high. If the post-processing time is short in a situation where the correction process for correcting a bend of a paper sheet P and the post-processing process for performing post-processing on a paper sheet P are performed for each one paper sheet P, the correction time should be shortened. Otherwise, a waiting time is generated between the post-processing process as the downstream-side process for the paper sheet P conveyed previously and the correction process as the upstream-side process for the paper sheet P to be conveyed next, resulting in a decrease in the overall productivity. In a case where the post-processing time is long, on the other hand, even if the correction time is made longer, no waiting time is generated between the post-processing step as the downstream-side process for the paper sheet P conveyed previously and the correction process as the upstream-side process for the paper sheet P to be conveyed next. Accordingly, even if a long time is consumed for bend correction, the overall productivity does not become lower. In a case where the leading edge of the paper sheet P being conveyed to the post-processor 71 is a short side, the bend of the paper sheet P is conspicuous, and therefore, it is preferable to select the CD alignment method that provides a high bend correction accuracy. Therefore, in a case where the post-processing time is long, and the leading edge of the paper sheet P being conveyed to the post-processor 71 is a short side, the CD alignment method is selected, to create a high-quality product while maintaining a high overall productivity.

Further, according to this embodiment, in a case where the post-processing time is shorter than a threshold time, and the rigidity of the paper sheet P is low or the rigidity of the paper sheet P is lower than a predetermined value, the roller registration method is selected. In a case where the post-processing time is shorter than the threshold time, and the rigidity of the paper sheet P is high or the rigidity of the paper sheet P is equal to or higher than the predetermined value, the steering method is selected. In a case where the rigidity of the paper sheet P is low, or the rigidity of the paper sheet P is lower than the predetermined value as in the case of thin paper, the paper sheet P is easily bent and put into a loop state when being brought into contact with the registration rollers 77C. Therefore, the roller registration method is suitable in such a case. On the other hand, in a case where the rigidity of the paper sheet P is high, or the rigidity of the paper sheet P is equal to or higher than the predetermined value as in the case of thick paper, it is difficult to bend the paper sheet P and put the paper sheet P into a loop state when the paper sheet P is brought into contact with the registration rollers 77C. Therefore, the roller registration method is not suitable in such a case. However, in a case where the rigidity of the paper sheet P is high, or the rigidity of the paper sheet P is equal to or higher than the predetermined value as in the case of thick paper, the paper sheet P has stiffness, and accordingly, the paper sheet P is easily rotated by a difference in conveyance velocity between the pair of steering rollers 77B. Therefore, the steering method is suitable in such a case.

Further, according to this embodiment, in a case where the post-processing time is equal to or longer than the threshold time, and the paper sheet P is a long paper sheet, the CD alignment method is selected. In the CD alignment method, productivity is low because the conveyance of the paper sheet P is suspended. However, in a case where the post-processing time is equal to or longer than the threshold time, and the paper sheet P has such a size that alignment is performed at a long side, or in a case where the leading edge of the paper sheet P being conveyed to the post-processor 71 is a short side, the bend correction accuracy is high. Therefore, in a case where the leading edge of a long paper sheet or a paper sheet P being conveyed to the post-processor 71 is a short side, the CD alignment method is selected. Note that the CD alignment method is selected in a case where the post-processing time is equal to or longer than the threshold time. Thus, it is possible to secure a certain bend correction accuracy while maintaining the overall productivity.

Further, according to this embodiment, in a case where the product is a booklet, the steering method is selected. Specifically, even in a saddle stitching mode for creating the covers and inside pages of a booklet, a high-quality product can be created when the bend correction accuracy for paper sheets P is high. However, as the bend correction accuracy for paper sheets P becomes higher, the overall productivity becomes lower. Therefore, if the bend correction accuracy for paper sheets P is made higher even for a product that does not require a high bend correction accuracy for paper sheets P, there is a possibility that the disadvantage to be given to the user will become larger due to a decrease in the overall productivity. For example, in the case of an image from which a bend is hardly detected, there is no need to increase the bend correction accuracy for paper sheets P by lowering the overall productivity. Therefore, in a case where post-processing is to be performed on the covers and inside pages of a normal booklet, it is preferable to select the steering method that provides a medium-level bend correction accuracy.

In a case where the post-processing time takes a long time as in a case where a scoring or perforating process is performed on the paper sheets P in a booklet, the overall productivity does not drop even if the time allotted as the correction time is increased. Accordingly, a long time can be allotted as the correction time, and thus, the overall productivity does not drop even with the CD alignment method. In other words, if a long time is required for the post-processing process that is the downstream-side process for the paper sheet P conveyed previously, it is possible to allot a long time to the correction process that is the upstream-side process for the paper sheet P to be conveyed next. Thus, it is possible to create a high-quality product while maintaining the overall productivity.

Further, in a case where the product is a business card, the CD alignment method is selected. Specifically; if the bend correction accuracy for paper sheets P is low, there is a possibility that a difference will be caused between the position of a business card image created at the top of a paper sheet P and the position of a business card image created at the bottom end of the paper sheet P. Because of this, in the business card mode for creating business cards, a bend correction method that provides a high bend correction accuracy is required, and therefore, the CD alignment method is selected. In other words, in a case where an image printed like a business card is an image in which a bend amount can be easily recognized, an increase in the bend correction accuracy is required, and therefore, the CD alignment method is selected. The CD alignment method requires a long correction time, and therefore, there is a possibility of a decrease in the overall productivity. However, a paper sheet P needs to be cut a large number of times, to turn into business cards. As a result, a long post-processing time is required. Accordingly, a long time can, be allotted as the correction time, and thus, the overall productivity does not drop even with the CD alignment method. Thus, it is possible to create a high-quality product while maintaining the overall productivity.

Further, according to this embodiment, in a case where bend correction is to be performed on paper sheets P, and the bend amount of an image printed on a paper sheet P is to be adjusted, the steering method is selected. By the steering method, the rotational velocity of each of the pair of steering rollers 77B is adjusted in accordance with the bend amount of an image printed on a paper sheet P. As a result, the bend amount of the image printed on the paper sheet P can be offset. Thus, paper sheets P can be conveyed to the post-processor 71 on the downstream side, with the orientations of images printed on paper sheets P being aligned.

Further, according to this embodiment, one of the bend correction methods is selected from among a plurality of bend correction methods, in accordance with the bend correction accuracy or the productivity of the product, whichever has the higher priority level. For example, in a case where a setting for prioritizing the bend correction accuracy even if the productivity is slightly lowered has been made, the bend correction accuracy is prioritized. Accordingly, an optimum bend correction accuracy is selected while a constant productivity such as 70% is maintained, for example. Further, in a case where a calculation is made to determine whether it is possible to increase productivity by changing bend correction methods, and a certain bend correction accuracy can be maintained at the post-processor 71, for example, it is possible to increase productivity by changing bend correction methods. Such a calculation should be performed by the controller 300.

Although an image forming system according to the present disclosure has been described on the basis of an embodiment, the present disclosure is not limited to this embodiment, and modifications may be made to it without departing from the scope of the present disclosure. For example, in this embodiment, an example in which an image forming system includes the image forming apparatus 2 and the post-processing apparatus 3 has been described, but the present disclosure is not limited to this particular example. For example, in addition to the image forming apparatus 2 and the post-processing apparatus 3, the image forming system may further include a sheet feeder apparatus, an image reading apparatus, a relay apparatus, and the like.

Further, in the example shown in FIG. 4 according to this embodiment, the bend correction accuracy depending on the rigidity of paper sheets P has been described, but the present disclosure is not limited to this particular example. For example, the bend correction accuracy may depend on the basis weight of a paper sheet P or the thickness of a paper sheet P. Specifically, a case where the rigidity of a paper sheet P is low or where the rigidity of a paper sheet P is lower than a predetermined value corresponds to a case where the basis weight of a paper sheet P is small or where the thickness of a paper sheet P is small, which is the case of thin paper. A case where the rigidity of a paper sheet P is high or where the rigidity of a paper sheet P is equal to or higher than a predetermined value corresponds to a case where the basis weight of a paper sheet P is large or where the thickness of a paper sheet P is great, which is the case of thick paper. Further, the basis weight of a paper sheet P or the thickness of a paper sheet P may also be used as a control parameter in practice.

Further, in this embodiment described above, the productivity of a product varies with the post-processing time and the correction time, for example. However, the present disclosure is not limited to this particular example. The productivity of a product also varies with the conveyance time of a paper sheet P.

Although embodiments of the present invention have been described and illustrated in detail, the disclosed embodiments are made for purposes of illustration and example only and not limitation. The scope of the present invention should be interpreted by terms of the appended claims.

What is claimed is:

1. A post-processing apparatus that performs post-processing on a paper sheet conveyed from a previous stage side, the post-processing apparatus comprising:

a corrector that performs bend correction on the paper sheet, in accordance with one of a plurality of bend correction methods;

a post-processor that performs the post-processing on the paper sheet subjected to the bend correction performed by the corrector; and a hardware processor that selects one of the plurality of bend correction methods, on the basis of a bend correction accuracy corresponding to a product to be created by the post-processing being performed by the post-processor, and a productivity of the product, wherein from the plurality of bend correction methods, the hardware processor selects a bend correction method that reduces a difference between a post-processing time required for the post-processor to perform the post-processing and a correction time required for the corrector to perform the bend correction on the paper sheet.

2. The post-processing apparatus according to claim 1, wherein, when the post-processing time is equal to or longer than a threshold time, the hardware processor selects a CD alignment method from the plurality of bend correction methods.

3. The post-processing apparatus according to claim 1, wherein, when the post-processing time is shorter than a threshold time, and a rigidity of the paper sheet is lower than a predetermined value, the hardware processor selects a roller registration method from the plurality of bend correction methods, and, when the post-processing time is shorter than the threshold time, and the rigidity of the paper sheet is equal to or higher than the predetermined value, the hardware processor selects a steering method from the plurality of bend correction methods.

4. The post-processing apparatus according to claim 1, wherein, when the post-processing time is equal to or longer than a threshold time, and the paper sheet is a long paper sheet or a leading edge of the paper sheet being conveyed to the post-processor is a short side, the hardware processor selects a CD alignment method.

5. The post-processing apparatus according to claim 1, wherein, when the product is a booklet, the hardware processor selects a steering method, and, when the product is a business card, the hardware processor selects a CD alignment method.

6. The post-processing apparatus according to claim 1, further comprising a pair of steering rollers disposed on an upstream side of the post-processor and in a direction orthogonal to a direction of conveyance of the paper sheet, wherein when bend correction is to be performed on the paper sheet, and a bend amount of an image printed on the paper sheet is to be adjusted, the hardware processor selects a steering method, and the steering method is to adjust a rotational velocity of each steering roller of the pair of the steering rollers, in accordance with a bend amount of an image printed on the paper sheet.

7. The post-processing apparatus according to claim 1, wherein the hardware processor selects one of the plurality of bend correction methods, in accordance with the bend correction accuracy or the productivity of the product, whichever has a higher priority level.

* * * * *